US006715155B2

(12) United States Patent
Duflos

(10) Patent No.: US 6,715,155 B2
(45) Date of Patent: Apr. 6, 2004

(54) PAIR OF PANTS EQUIPPED WITH A TIGHTENING STRAP

(75) Inventor: Sophie Duflos, Miribel les Echelles (FR)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 10/200,620

(22) Filed: Jul. 22, 2002

(65) Prior Publication Data

US 2003/0014807 A1 Jan. 23, 2003

(30) Foreign Application Priority Data

Jul. 20, 2001 (FR) ..... 01 09716

(51) Int. Cl.[7] ..... A41F 9/00
(52) U.S. Cl. ..... 2/237; 2/236
(58) Field of Search ..... 2/220, 221, 234, 2/235, 236, 237, 338, 339, 322, 321, 312, 311, 76, 219, 161.4, 171.4, 171.5, 913, 227, 228, 238, 211, 212

(56) References Cited

U.S. PATENT DOCUMENTS

| | | | | | |
|---|---|---|---|---|---|
| 143,947 | A | * | 10/1873 | Weil | 2/237 |
| 321,962 | A | * | 7/1885 | Goodman | 2/237 |
| 665,518 | A | * | 1/1901 | Goodman | 2/237 |
| 690,635 | A | * | 1/1902 | Carter | 2/400 |
| 1,018,009 | A | * | 2/1912 | Schremp | 2/400 |
| 1,614,965 | A | * | 1/1927 | Margolith | 2/236 |
| 1,937,356 | A | * | 11/1933 | Neustadt | 2/237 |
| 2,087,357 | A | * | 7/1937 | Persson | 2/237 |
| 2,418,772 | A | * | 4/1947 | Jackson | 2/235 |
| 2,493,813 | A | * | 1/1950 | Greenblatt et al. | 2/237 |
| 2,583,992 | A | * | 1/1952 | Bouteloup | 2/237 |
| 3,164,844 | A | * | 1/1965 | Ruby | 2/221 |
| 3,292,184 | A | * | 12/1966 | Anderson | 2/221 |
| 3,784,986 | A | * | 1/1974 | Klaproth | 2/237 |
| 3,835,473 | A | * | 9/1974 | Toyoda | 2/237 |
| 4,193,136 | A | * | 3/1980 | Pierce | 2/237 |
| 5,575,011 | A | * | 11/1996 | Allen | 2/227 |
| 5,598,586 | A | * | 2/1997 | Munjone | 2/237 |
| 6,081,930 | A | | 7/2000 | Phillips | 2/237 |
| 6,237,160 | B1 | * | 5/2001 | Bouville | 2/311 |
| 6,272,691 | B1 | * | 8/2001 | Henricksen et al. | 2/338 |

FOREIGN PATENT DOCUMENTS

| | | |
|---|---|---|
| FR | 788 327 | 4/1935 |
| FR | 1471674 | 3/1966 |
| FR | 2 777 755 A1 | 4/1999 |
| FR | 2 805 131 A1 | 2/2000 |

* cited by examiner

*Primary Examiner*—John J. Calvert
*Assistant Examiner*—Alissa L. Hoey
(74) *Attorney, Agent, or Firm*—Heslin Rothenberg Farley & Mesiti P.C.; Victor A. Cardona, Esq.

(57) ABSTRACT

A pair of pants comprising a closure region with two flaps (5, 6) which partially overlap and are equipped with means for holding one with respect to the other, and which also comprises:

a casing (10) going around the waist of the pants;

a strap (11) able to slide inside the casing (10), one end of the strap (11) being fixed to a region of the casing, the other end (12) being free and re-emerging from the casing at a first flap (6);

an eyelet (22) arranged on the second flap (5) and able to have the free end (12) of the strap (11) passed through it;

means of securing the free end (12) of the strap to the first flap (6) of the pants when said free end (12) passes through the eyelet (22) and is folded back onto the first flap (6).

7 Claims, 3 Drawing Sheets

PAIR OF PANTS EQUIPPED WITH A TIGHTENING STRAP

CROSS REFERENCE TO RELATED APPLICATIONS

This application is claiming priority from French Application No. 01 09716, filed Jul. 20, 2001, the entire disclosure of which is incorporated herein by reference.

TECHNICAL FIELD

The invention relates to the sector of clothing, and more specifically to that of sportswear or leisure wear. It is aimed more specifically at a pair of pants equipped with a special arrangement to allow them to be tightened in at the waist, without having to resort to an attached belt.

PRIOR ART

In general, a pair of pants comprises a closure region situated at the front of its upper part. This closure region comprises two flaps which partially overlap. When these two flaps are parted from one another they allow the user to put the pants on. When the two flaps are secured to one another, the top of the pair of pants passes around the waist of the user, and this holds the pants in position. The two flaps of the closure region are generally held together by a fly and a top button connecting the two top ends of the flap. The fly may be equipped either with a zipper or with buttons, or alternatively with fabric of the hook and loop type. The top button may possibly be replaced by a press stud or any other equivalent means that allows the two flaps to be held together.

Pants are generally equipped with various belt loops situated around the waist, so as to allow a belt to be slipped through which is tightened at the front of the pants. This belt allows the waist of the pants to be tightened in to prevent the pants from slipping down over the hips.

The use of a belt proves to be somewhat unsuitable as far as leisure wear or sportswear is concerned: such pants are made of relatively stretchy fabrics and the waist of the pants may deform between the various belt loops that carry the belt. Furthermore, the belt buckle forms an additional thickness at the waist and this may prove annoying.

It has already been proposed for certain sports pants to be equipped with a drawstring. This drawstring is contained in a fold at the waist of the pants, and which goes around the waist. This drawstring re-emerges at both ends at an eyelet made in the fold. The tightening of the drawstring tightens-in the waist of the pants. This solution is difficult to transfer across to pants which have a closure region with flaps. Such a transfer would entail fitting two different eyelets at the waist of the pants, to allow the drawstring to pass through. It then follows that one end of the drawstring may disappear up inside the fold made in the waist, making tightening impossible.

The invention sets out to alleviate these various drawbacks by providing a pair of pants which allows progressive effective tightening which is hassle-free for the user.

SUMMARY OF THE INVENTION

The invention therefore relates to a pair of pants comprising a closure region with two flaps which partially overlap and are equipped with means for holding one with respect to the other.

According to the invention, this pair of pants is one which also comprises:

a casing going around the waist of the pants;

a strap able to slide inside the casing, one end of the strap being fixed to a region of the casing, the other end being free and re-emerging from the casing at a first flap;

an eyelet arranged on the second flap and able to have the free end of the strap passed through it;

means of securing the free end of the strap to the first flap of the pants when said free end passes through the eyelet and is folded back onto the first flap.

In other words, the pants have an internal belt which is arranged in a casing made at the waist. This casing can gather slightly when the strap is pulled. This strap protrudes from the flap of the pants, and allows the other flap to be pulled by pulling on an eyelet. When the free end of the strap is secured to the first flap, the second flap and therefore the fixed end of the strap are therefore kept under tension with respect to the first flap.

As the strap is relatively flat, it does not form additional thickness when secured to the flap, unlike that which is observed when using a conventional belt.

Advantageously in practice, the means of securing the free end of the strap to the first flap of the pants allow the relative position of the strap on the flap to be adjusted. In other words, the tightening of the strap can be adjusted to suit the user's wishes, thus making it possible to a certain extent to compensate for the difference between the waist size of the pants and the waist size of the user.

Advantageously in practice, these means of securing the strap to the first flap of the pants are formed of portions of fabric of the hook and loop type, which allow continuous adjustment of the tightening.

In one particular embodiment, the portion of hook and loop fabric secured to the flap is stitched to a piece of fabric attached to the flap. This piece then comprises an opening to allow the free end of the strap which emerges from the casing to pass through. This arrangement strengthens the region of attachment of the strap to the flap.

Advantageously in practice, the strap is secured to the casing at the second flap so as to pass around the waist of the pants. In other words, the strap goes around the waist of the pants, and is stitched to the flap more or less at the eyelet, so that it is the strap itself, rather than portions of the pants, which perform the tightening.

Advantageously in practice, the means of holding one flap with respect to the other are formed of a button and of a buttonhole each arranged on one flap.

In practice, it is preferable for the button to be stitched to the inside face of the flap, so as to avoid forming a region likely to become caught on obstacles.

BRIEF DESCRIPTION OF THE DRAWINGS

The way of achieving the invention and the advantages which ensue therefrom, will become clearly apparent from the description of the embodiment which follows, in support of the appended figures in which.

EMBODIMENT OF THE INVENTION

Figure 1:
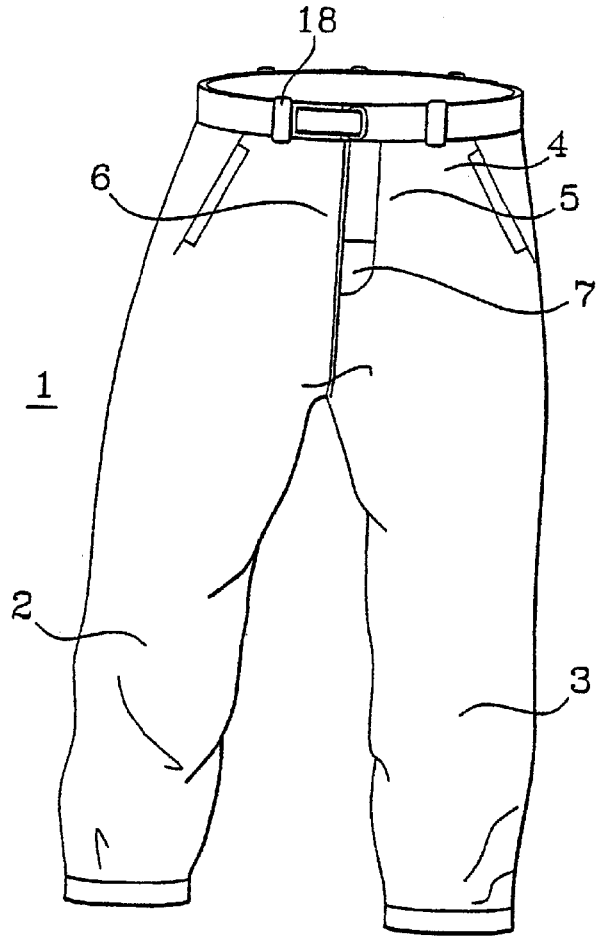
FIG. 1 is a general view of a pair of pants according to the invention.
Figure 2:
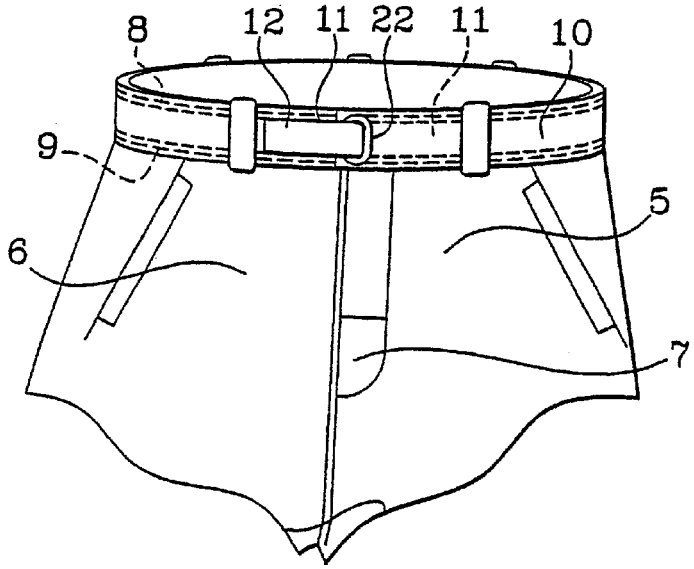
FIG. 2 is a detail view showing the region of the waist of the pants of FIG. 1.

The invention relates to a pair of pants (1) as illustrated in FIG. 1. Such pants have two legs (2, 3) and an upper portion (4) situated at waist height. This top portion comprises a closure region with two flaps (5, 6) that partially overlap. These flaps are connected at their bottom part at a fly (7) by a device which has not been depicted but which has no particular impact on the invention. At the waist, and as illustrated in FIG. 2, the pants have a casing produced by seams (8, 9) sewn into a fold of the fabric. This casing (10), which goes around the waist of the pants, accommodates a strap (11) made of a preferably non-stretch material, and typically of polyamide. This strap (11) can slide freely inside the casing (10) so as to allow the waist of the pants to be gathered slightly.

Figure 3:
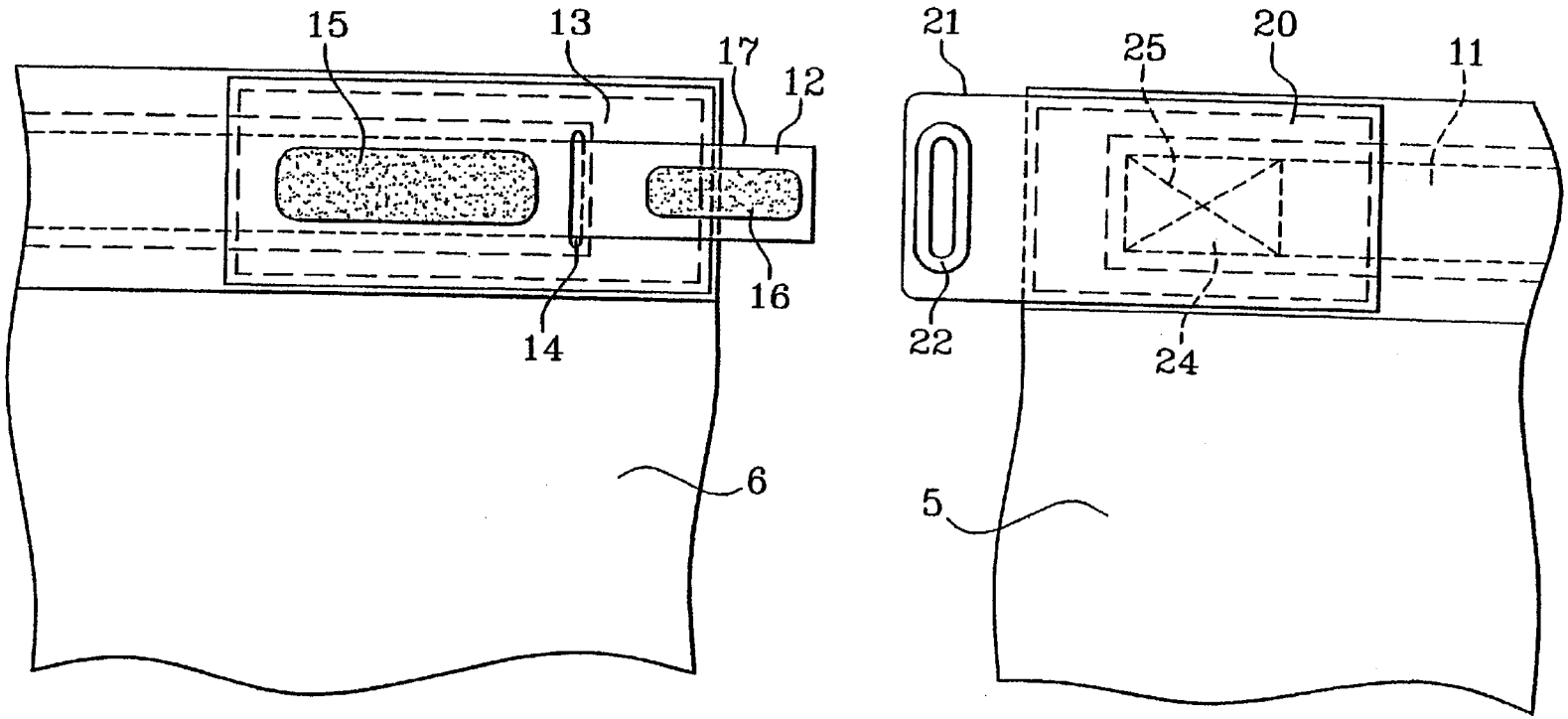
FIG. 3 is a more precise detail view showing the two parts of the flaps of the pants collaborating in accordance with the invention.

As illustrated in FIG. 3, this strap allows the tightening of the waist of the pants to be adjusted. More specifically, at a first flap (6), the casing opens onto the outside face of the flap, so as to allow the free end (12) of the strap (11) to emerge. At the corner of this first flap (6) there has been stitched an additional piece (13) which has an opening (14) allowing the free end (12) of the strap (11) to pass through. By virtue of this opening (14) it is possible to pull the end (12) of the strap (11) in such a way as to cause this strap (11) to slide in the casing (10). The additional piece (13) has a region (15) made of a fabric of the hook and loop type, known by the trade name VELCRO®. To complement this, the free end (12) of the strap (11) has a region (16) stitched to the face intended to come into contact with the region (15) of the piece (13) when the free end (12) of the strap is folded down onto the flap (6). This region (16) is made of a fabric of the hook and loop type, in the texture that complements that of the region (15).

At the second flap (5), the pants are equipped with an additional piece (20) stitched to the corner of the flap (5). This piece comprises, at its end (21), facing the other flap, an eyelet (22) of elongate shape. This eyelet has a height, measured in the vertical direction, that slightly exceeds the breadth of the strap (11). This piece (20) is stitched to the flap (5) by peripheral stitching.

Underneath this piece (20), the fixed end (24) of the strap (11) is also stitched to the flap, via various seams (25). These seams (25) may be achieved either on the top or on the underside of the piece (20). On its inside face, the flap has a button (26) intended to be buttoned into a buttonhole (25) situated on the opposite flap.

Figure 4:
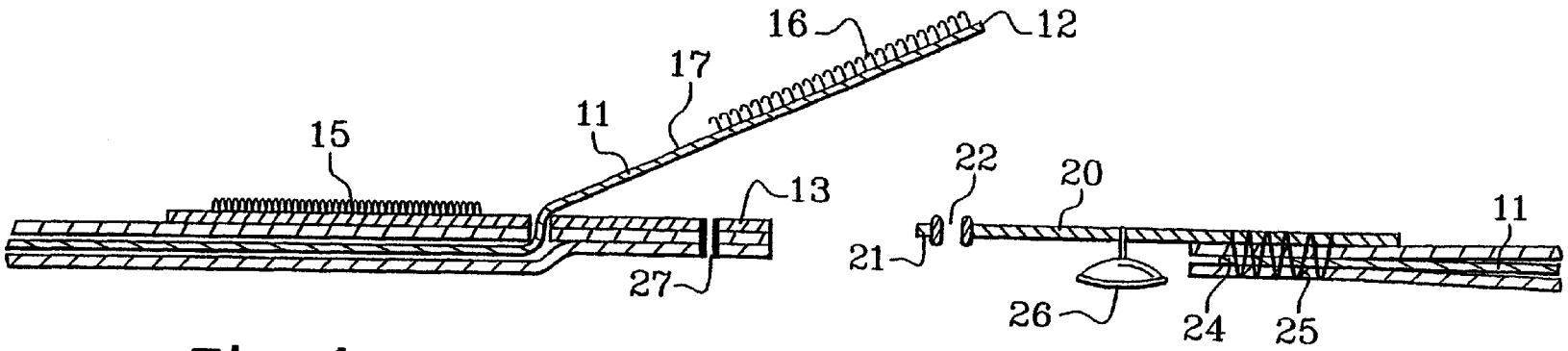
FIGS. 4 and 5 are views in horizontal section, at the middle of the strap, of the two flaps shown, in the case of FIG. 4, before doing up and, in the case of FIG. 5, after doing up.
Figure 5:
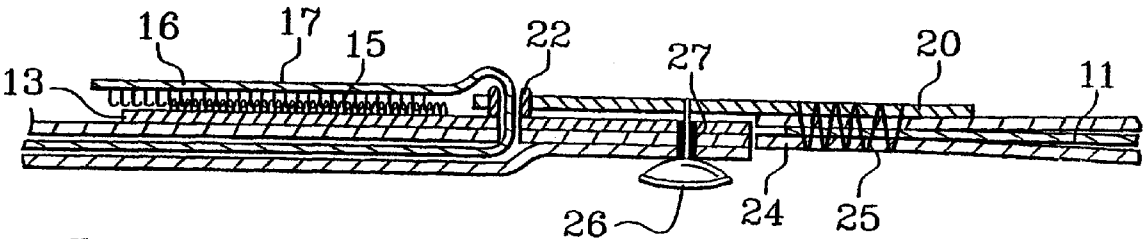

The pants are done up as illustrated in FIGS. 4 and 5. Thus, having buttoned the button (26) into the buttonhole (27), the free end (21) of the piece (20) can be pulled forward. The eyelet (22) is then ready to receive the free end (12) of the strap (11). A pulling action is then exerted on this end (12) which tightens the strap around the waist of the pants. The flap (17) is then folded onto the fixed flap of the pants. The regions (15, 16) made of hook and loop fabric join together, thus preventing the strap (11) from sliding in the casing (10). This adjustment may, of course, be continuous, thanks to the use of the hook and loop fabric.

The pants can also take a conventional belt which is held in place by virtue of the presence of belt loops (18) distributed around the waistband.

It is apparent from the foregoing that the pants according to the invention have many advantages, particularly that of allowing the waist of the pants to be tightened precisely, without generating additional thickness which prove uncomfortable to the user.

What is claimed is:

1. A pair of pants comprising a closure region with two flaps which partially overlap and are equipped with means for holding one with respect to the other, said closure region comprising:

a casing around the waist of the pants;

a strap for sliding inside the casing, a first end of the strap being fixed to a casing in a region of a first flap of the two flaps, a second end of the strap being free and exiting from the casing at a second flap of the two flaps;

an eyelet arranged on said first flap and configured to allow the second end of the strap to pass through said eyelet;

means for securing the second end of the strap to the second flap of the pants when said second end passes through the eyelet and is folded back onto the second flap to be secured on the second flap.

2. The pair of pants as claimed in claim 1, wherein the means for securing the second end of the strap to the second flap of the pants allow the relative position of the strap on the second flap to be adjusted.

3. The pair of pants as claimed in claim 2, wherein the means for securing the second end of the strap to the second flap of the pants are formed of portions of fabric of a hook and loop type.

4. The pair of pants as claimed in claim 3, wherein the portion of hook and loop fabric secured to the second flap is stitched to a piece of fabric attached to the second flap, said piece having an opening to allow the second end of the strap to pass through said opening.

5. The pair of pants as claimed in claim 1, wherein the strap is secured to the casing at the first flap so as to pass around the waist of the pants.

6. The pair of pants as claimed in claim 1, wherein the means for holding one flap with respect to the other are formed of a button and of a buttonhole each arranged on one flap of the two flaps.

7. The pair of pants as claimed in claim 6, wherein the button is switched to the inside face of one flap of the two flaps.

* * * * *